US008596414B1

(12) United States Patent
Lown

(10) Patent No.: US 8,596,414 B1
(45) Date of Patent: Dec. 3, 2013

(54) MOBILE STEEP ROOF SCAFFOLD SYSTEM

(76) Inventor: Thomas R. Lown, Waterloo, IA (US)

( * ) Notice: Subject to any disclaimer, the term of this patent is extended or adjusted under 35 U.S.C. 154(b) by 112 days.

(21) Appl. No.: 13/080,062

(22) Filed: Apr. 5, 2011

Related U.S. Application Data

(60) Provisional application No. 61/322,974, filed on Apr. 12, 2010.

(51) Int. Cl.
*E04G 1/36* (2006.01)

(52) U.S. Cl.
USPC ..... 182/45

(58) Field of Classification Search
USPC ..... 182/45, 206, 12; 52/749.12
See application file for complete search history.

(56) References Cited

U.S. PATENT DOCUMENTS

| | | | | | |
|---|---|---|---|---|---|
| 1,423,998 | A * | 7/1922 | Camp | 182/38 |
| 2,426,825 | A * | 9/1947 | Geary | 248/237 |
| 2,814,533 | A * | 11/1957 | Van Horn | 182/14 |
| 4,397,375 | A * | 8/1983 | Hart | 182/206 |
| 5,624,006 | A * | 4/1997 | Richardson, Jr. | 182/45 |
| 6,003,629 | A * | 12/1999 | Cloutier et al. | 182/45 |
| 6,533,070 | B1 * | 3/2003 | Elrod | 182/103 |
| 2007/0062761 | A1 | 3/2007 | Megna et al. | |
| 2008/0006481 | A1 | 1/2008 | Vieira | |

FOREIGN PATENT DOCUMENTS

| | | |
|---|---|---|
| GB | 2201716 | 9/1988 |

* cited by examiner

*Primary Examiner* — James O Hansen
*Assistant Examiner* — Kristine Florio
(74) *Attorney, Agent, or Firm* — Allan L Harms; Shuttleworth & Ingersoll, PLC

(57) ABSTRACT

An improved roof scaffolding system for a steeply pitched roof includes a pair of rails supported on casters and connected by planks supported on plank support brackets mounted along the rails. Each rail includes a ridge hook which reaches over the roof ridge and rests on a caster touching the opposite side of the roof. When the scaffolding system is to be moved laterally along the roof on which work is to be done, the rails may roll on the casters to the desired location. When the scaffolding system is in place for work to be done, stand assemblies can lower stands which raise the rails off the casters supporting them. Optionally a gable anchor is used to provide a connection point for a rope cable which may be pulled to move the scaffolding system toward the gable end on which the anchor is located.

13 Claims, 12 Drawing Sheets

MOBILE STEEP ROOF SCAFFOLD SYSTEM

CROSS REFERENCE TO RELATED APPLICATIONS

The present application claims priority under 35 USC §119 to provisional application 61/322,974 filed Apr. 12, 2010, which is incorporated herein by reference.

BACKGROUND

This invention pertains to scaffolding and particularly to scaffolding used in installation roofing materials on a sloped or pitched roof, especially for a steeply pitched roof. Historically, support for roofers working on steeply pitched roofs has consisted of temporary installation of horizontally oriented boards on which workers perch to apply shingles and other roofing materials. Later toe-hold brackets were developed which could be temporarily mounted to the roof deck to support planks resting on pairs of the toe-hold brackets.

When toe-hold brackets are used, the planks on which workers are supported abut the roof surface and prevent debris such as removed shingles and worn roofing materials from sliding off the roof surface.

Recent efforts to improve on scaffolding for pitched roofs have led to elongate beams lying upon the roof surface to be repaired. These rails are hooked over the roof ridge between the sloped side being roofed or repaired and a second side on the other side of the ridge. See Megna, et al. (US Patent Publication No. 2007/0062761) and Vierra (US Patent Publication No. 2008/0006481).

The beams are used in pairs and are equipped with plank supports which are carried on the rails. No provision is made to easily move the scaffold bars as work progresses. This is a shortcoming because much time and effort must be expended to move the scaffold members along the roof. A better scaffolding system for roofing installers is needed which provides easy movement along the roof surface while providing a safe work environment for the workers standing on the scaffolding.

SUMMARY OF THE INVENTION

This invention is an improved, movable scaffold system for use on steeply pitched roofs. The scaffold system includes a pair of rails which are spaced apart and maintained generally in parallel by cross members which are fastened to the rails 12 by removable fasteners. A plank support bracket is supported on each rail to provide support for an elongate plant on which workers can walk or stand. The plank support brackets can be moved along the rails and are positioned such that the plank will be substantially horizontal. Each rail includes a ridge hook which overhangs the roof ridge sufficiently to hold the rail along the side of the roof. The roof hooks include casters on the legs which extend over the ridge of the roof. The casters either swivel or are positioned so that lateral movement along the back side of the roof is possible. Casters are also mounted under each rail to support the rail above the surface of the side of the roof on which work is to be done. These casters must either swivel into position perpendicular to the rail or be fixed in that orientation.

A stand assembly is associated with each caster on the rails such that the stand assembly can lower a foot against the roof surface to raise the caster off the roof surface, in order to stabilize the rails on the roof. Like casters 32, caster 42 may also be of the freely swiveling variety or it may be fixed such that it will roll in a generally horizontal direction along roof 3.

When it is desired to move the scaffold system laterally along the roof the stand feet are raised sufficiently so that each rail becomes supported by the casters mounted to it.

The rails include telescoping sections which may be locked into position by pins. Holes along the rails allow the plank support brackets to be relocated along the rails.

The ridge hooks each have a ring mounted to them so that safety harness of a worker can be attached to one or another of the ridge hooks.

In other embodiments anchor may be attached to a gable end of the roof to provide a connection for a cable or rope which can be used to draw the scaffold system toward the gable end at which the anchor is attached.

In another embodiment of the scaffold movement system to be optionally used with scaffold invention 2, as seen in FIG. 11, a cable winch 270 may be attached to one of the rails 12, with the free end of the cable 272 of the winch 270 connected to the anchor post 244. Winch 270 is supported on a bracket 274 secured to the rail 12. By powering the cable winch 270 by electricity, including optionally by a battery positioned on one of rails 12, a worker may operate the winch 270 to draw the scaffold system 2 nearer to the anchor member 240.

These alternative embodiments of FIGS. 9-12 enhance the safety of operation of the scaffold system invention 2 by allowing the worker to move the scaffold system 2 along the roof while safely standing on the ground.

It is a primary object of this invention to provide a safe and convenient roof scaffold system for a pitched roof which allows the scaffolding to move along the roof laterally as work progresses.

It is a further object of the invention to provide a scaffold system which is movable but which may be stabilized in a given location by use of a stand assembly which raises the scaffold off the casters which support it when it is to be moved.

It is yet a further object of the invention to provide a scaffold system which may be moved along roof to be repaired by use of a rope and pulleys or by use of a powered winch and cable.

These and other objects of the invention will be understood by reference to the detailed description which follows.

DETAILED DESCRIPTION

The present invention provides a movable scaffold structure used for roofing activities on steeply pitched roofs.

Figure 1:
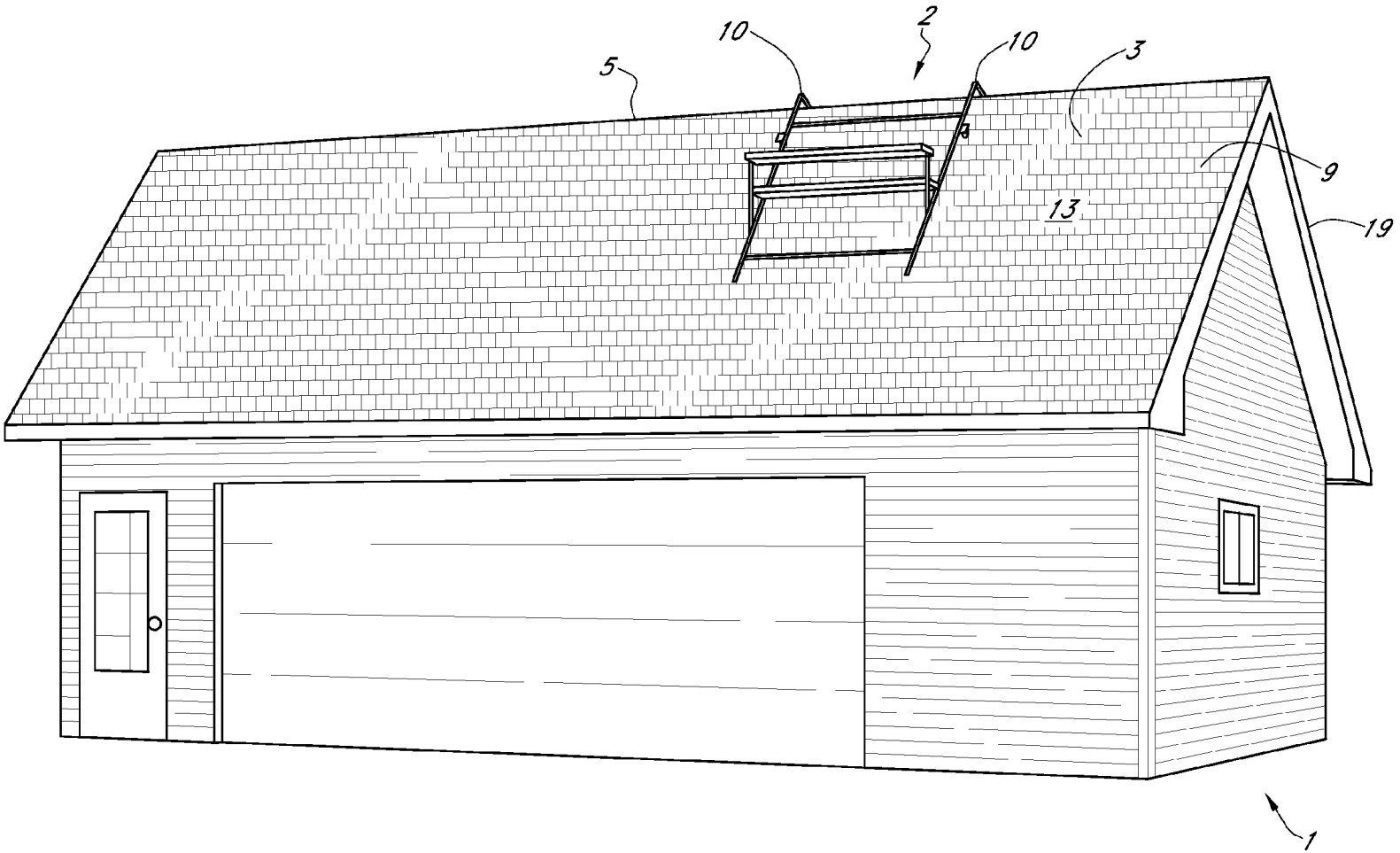
FIG. 1 is a perspective of a dwelling having the invention supported on the roof thereof.
Figure 2:
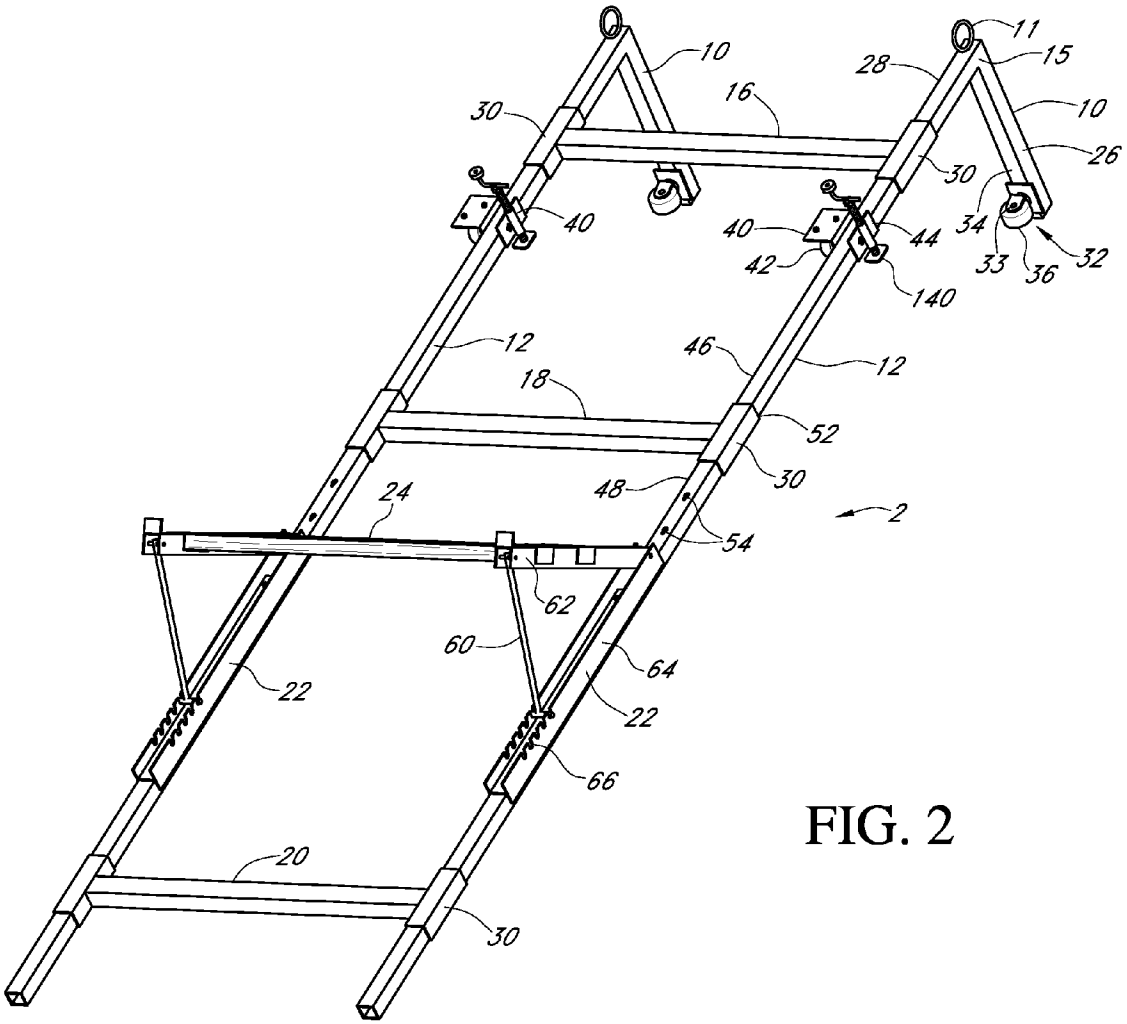
FIG. 2 is a perspective of the scaffold invention.

FIG. 1 illustrates the invention 2 in place and supported on the roof 3 of a building 1. Invention 2 includes a pair of ridge hooks 10 which extend over the ridge 5 of the roof 3.

Referring now to FIGS. 2-7 along with FIG. 1, it can be seen that Invention 2 comprises a pair of rails 12 which are spaced apart and maintained generally in parallel by cross members 16, 18 and 20 which are removably fastened to rails 12 by pins or like removable fasteners. Cross members 16, 18 and 20 are generally equivalent in length. Plank 24 may also be similar in length to cross members 16, 18, 20.

A plank support bracket 22 is supported on each rail 12 to provide support for an elongate plank 24. Plank 24 may be a 2"×8" wooden board or it may be some other generally planar elongate platform member which will support the weight of a worker standing on it. Plank support brackets 22 are selectively located along rails 12 and may be independently incrementally moved along rails 12. Preferably, plank support brackets 22 are positioned such that plank 24 will be substantially horizontal.

Each rail 12 is provided with a ridge hook 10 which includes a first leg 26 which joins a second leg 28 at a substantial angle. Preferably, first leg 26 joins second leg 78 at an angle of approximately 50° to 90° and more preferably at about 65°.

Second legs 28 are joined coaxially to rails 12 by joiners 30. A joiner 30 is welded to each ridge hook 10 at the end of second leg 28 and may consist of a hollow sleeve which receives a short segment of the second leg 28 and is welded thereto. Rail 12 is received in joiner 30 and retained therein by a removable fastener such as a clevis pin.

Each ridge hook 10 includes a caster 32 on the first leg 26 thereof. Caster 32 may be a swivel caster which will rotate freely on ridge hook 10 or it may be a fixed direction caster which is oriented so that the axle 33 of caster wheel 36 is parallel to the longitudinal axis of first leg 26. Each caster 32 is mounted on the underside 34 of first leg 26 so that the caster wheel 36 thereof will touchingly engage the roof surface on the opposite second side 19 of the ridge 5 from the location of rails 12. Casters 32 permit invention 2 to be moved sideways along roof 3, that is casters 32 are oriented to roll in a direction perpendicular to the axis of the rails 12.

Each rail 12 is provided with a stand and caster assembly 40. Each stand and caster assembly 40 provides structure which is used to selectively stabilize the invention 2 at a given location upon first side 9 of roof 3. Particularly, each stand and caster assembly 40 allows a stand foot 140 to be lowered into abutment with the outer surface 13 of first side 9 of roof 3 and to slightly elevate each rail 12 from the first side 9 of roof 3 so that the caster 42 of each stand and caster assembly 40 is separated from the roof 3 a small distance. Like casters 32, each caster 42 may also be of the freely swiveling variety or it may be fixed such that it will roll in a generally horizontal direction perpendicular to the longitudinal axis 12 of the rail 12 to which is fastened.

By raising each rail 12 through use of stand member 44 (See FIG. 5), a gap is increase between plank 24 and outer surface 12 of roof 3 so that removed shingles or other discards may slide down roof surface 13 and may be disposed of from roof 3 without collecting on plank 24.

When it is desired to move invention 2 along roof 3, the stand element 44 is manually operated to raise stand foot 140 sufficiently so that rail 12 becomes supported by caster 42 upon roof 3.

Rails 12 may include elongate segments 46, 48 which are joined coaxially by a joiner 30. Joiner 30 allows segment 48 to telescope slightly thereinto where it may be locked in place with a clevis pin, a bolt or another suitable fastener. Joiner 30 is welded to the lower end 52 of segment 46. Segment 48 is preferably placed below segment 46 because segment 48 includes locking openings or slotted holes 54 which may receive the head of a bolt extending from plank support bracket 22 to lock into a narrowed slot of a slotted hole 54.

Each plank support bracket 22 comprises a brace 60 which supports plank support arm 62 at a selected angle above plank support base member 64. A series of slots 66 is formed in the plank support bracket base 64 to allow variable location of brace 60 upon plank support bracket base 64 which allows variability of the tilt of plank support arm 62 relative to the axis of rail 12.

Each ridge hook 10 is provided with a loop or ring 11 near the junction 15 of first leg 26 and second leg 28 thereof. Rings 11 are provided to create attachment points for safety harness of users of invention 2.

Figure 3:
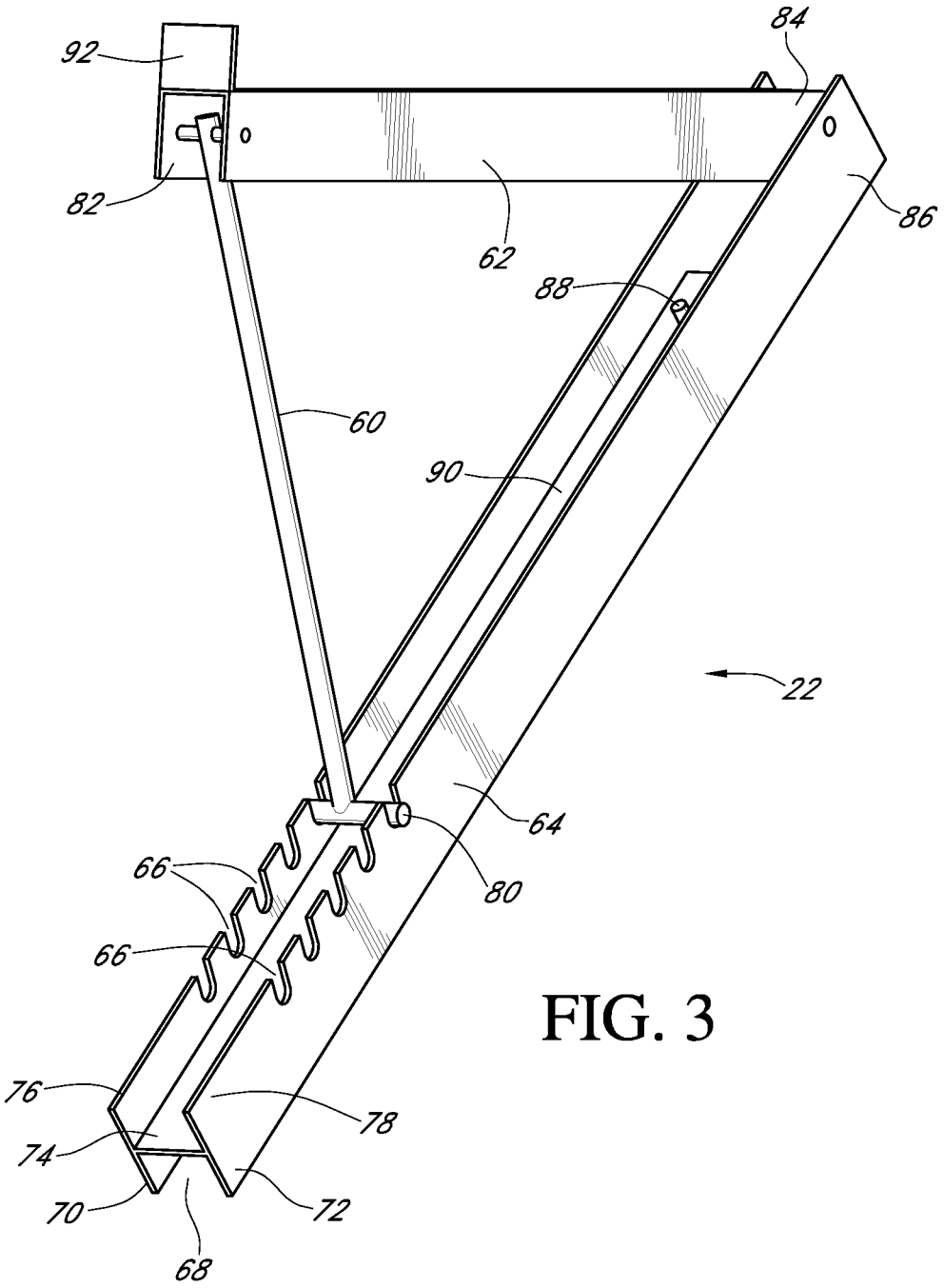
FIG. 3 is a perspective of the plank support bracket member of the invention.

FIG. 3 isolates plank support bracket 22 from the other elements of invention 2 for a clearer examination of the structure thereof.

Plank support bracket base 64 is constructed of elongate double channel stock of an I-beam cross section oriented such that lower channel 68 of plank support bracket base 64 may snugly overlie the rail 12 in a fashion such that sidewalls 70, 72 of plank support bracket base 64 rest along opposing side edges of rail 12.

Upper channel 74 is defined by upper channel sidewalls 76, 78 into which slots 66 are formed such that T-handle 80 of brace 60 may be inserted into a selected pair of slots 66 on opposing upper channel sidewalls 76, 78.

It can be seen that brace 60 is hinged to free end 82 of plank support arm 62 while opposing end 84 of plank support arm 62 is hinged to first end 86 of plank support bracket base 64.

An inverted bolt 88, preferably a carriage bolt, is welded to plank support bracket base 64 such that the head thereof will extend below central wall 90 of plank support bracket base 46. See description of FIG. 6A for additional details.

The distal end of 82 of plank support arm 62 is provided with an upstanding stop plate 92 which is oriented at a substantial perpendicular to the longitudinal axis of plank support arm 62. The stop plate 92 prevents a plank 24 (see FIG. 2) from sliding off plank support arm 62.

Figure 4:
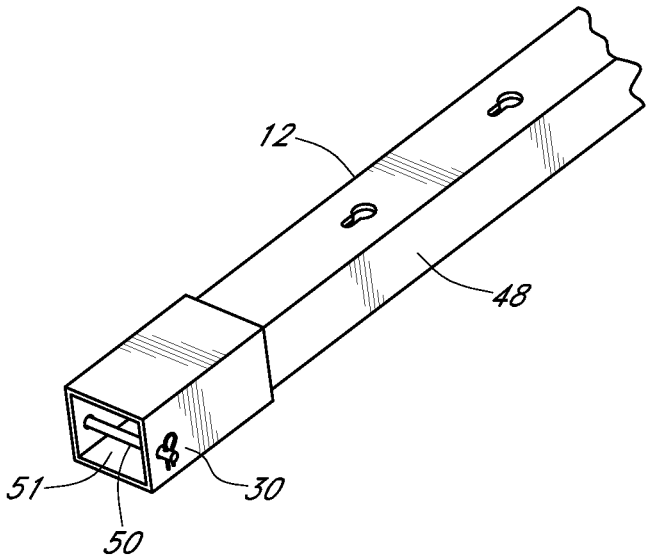
FIG. 4 is an enlarged perspective of a lower segment of one of the rail members of the invention.

FIG. 4 illustrates a segment 48 of rail 12 with joiner 30 welded thereto and with a receiving cavity 51 into which an end of another segment of rail 12 may be inserted and retained a clevis pin 50.

Figure 5:
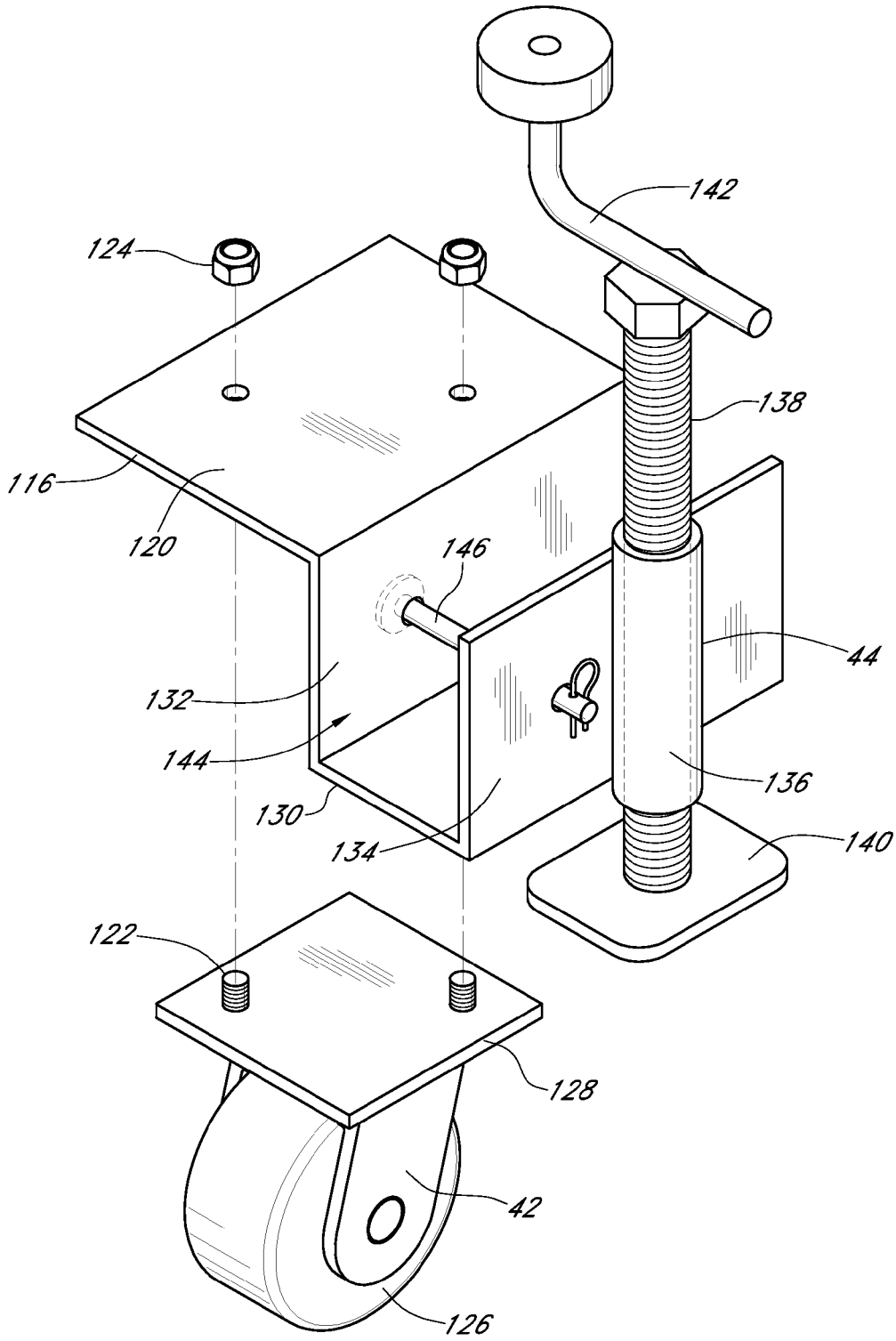
FIG. 5 is an enlarged perspective of the stand and roller assembly of the invention.

FIG. 5 shows the stand and caster assembly 40 enlarged and partly disassembled. Stand and caster assembly 40 comprises a mounting bracket 116, a swiveling caster 42 and a jack stand 44. Caster 42 mounts below first plate 120 of bracket 116 and is secured by studs 122 and nuts 124. Caster 42 is selected such that the caster wheel 126 and swivel plate 128 are taller than the sidewalls 132, 134 of channel 130. First sidewall 132 is integrally formed with first plate 120 and is disposed generally vertically when in position on a rail 12.

Second sidewall 134 of channel 130 parallels first sidewall 132 and supports bushing 136 which is welded to channel 130 of jack stand 44. Bushing 136 is internally threaded such that rotation of jack screw 138 causes foot 140 to rise or descend. A crank 142 facilitates rotation of jack screw 138.

Channel 130 provides an elongate cavity 144 which can receive rail 12 from below while clevis pin 146 may lock stand and caster assembly 40 to rail 12, passing through openings in the rail 12.

Additional stand and caster assemblies 40 may be utilized along rails 12 when rails 12 are especially long as with a very tall roof.

Figure 6A:
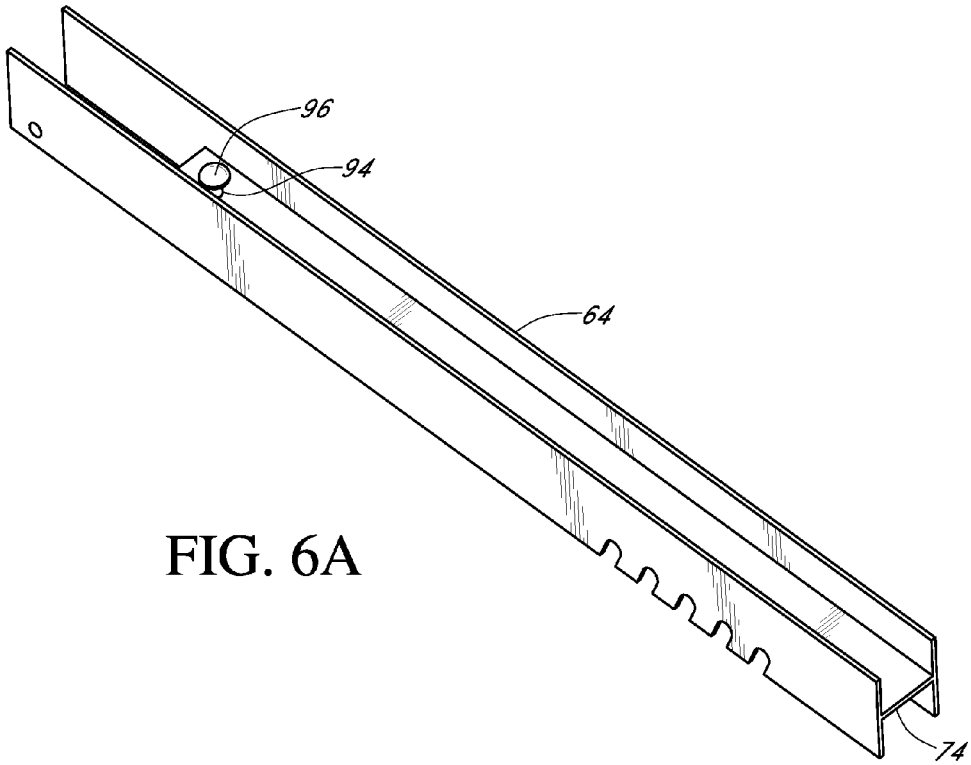
FIG. 6A is an enlarged perspective of the underside of the plank support bracket base of a plank support bracket of the invention.

FIG. 6A illustrates the plank support bracket base 64 from its underside. It can be seen that the head end 94 and head 96 of bolt 88 (See FIG. 3) extend from central wall 74 such that head 96 can enter one of locking, openings 54 of rail 12 to secure plank support bracket base 64 to the rail 12. When plank support bracket 12 is to be moved, plank support bracket base 64 is urged upward along rail 12 until head 96 can be removed from the locking opening 54 in which it was inserted earlier.

Figure 6B:
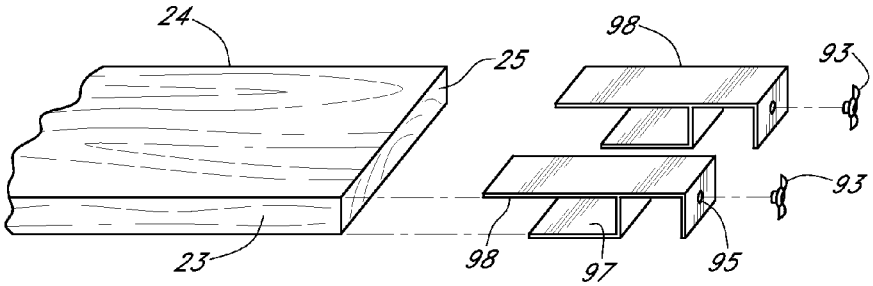
FIG. 6B is an exploded view of the plank end brackets of the invention.

FIG. 6B reveals detail of end bracket members 98 attached to plank 24. A pair or end bracket members 98 is fixed to each end of plank 24, spaced apart a distance slightly greater than the width of an end bracket member 98. By arranging the pairs of end bracket members 98 alternating on opposing ends of plank 24, a second plank 24 can be placed in end-to-end fashion with first plank 24 when a third rail 12 is added to the scaffold system invention 2. That is, one end bracket member 98 is aligned with the front edge 23 of plank 24, the second end bracket member 87 is fitted to end 25 but spaced away from the first end bracket member 98. This allows end bracket members 98 of another plank 24 to be interleaved with those of end 25.

Each end bracket member 98 comprises a receiving channel 97 which securely receives the end 25 of plank 24, and a hook element 95 which will snugly fit over the plank support arm 62 at each end of plank 24. A set screw 93 may be hand tightened to lock hook element 95 to plank support arm 24.

Figure 7:
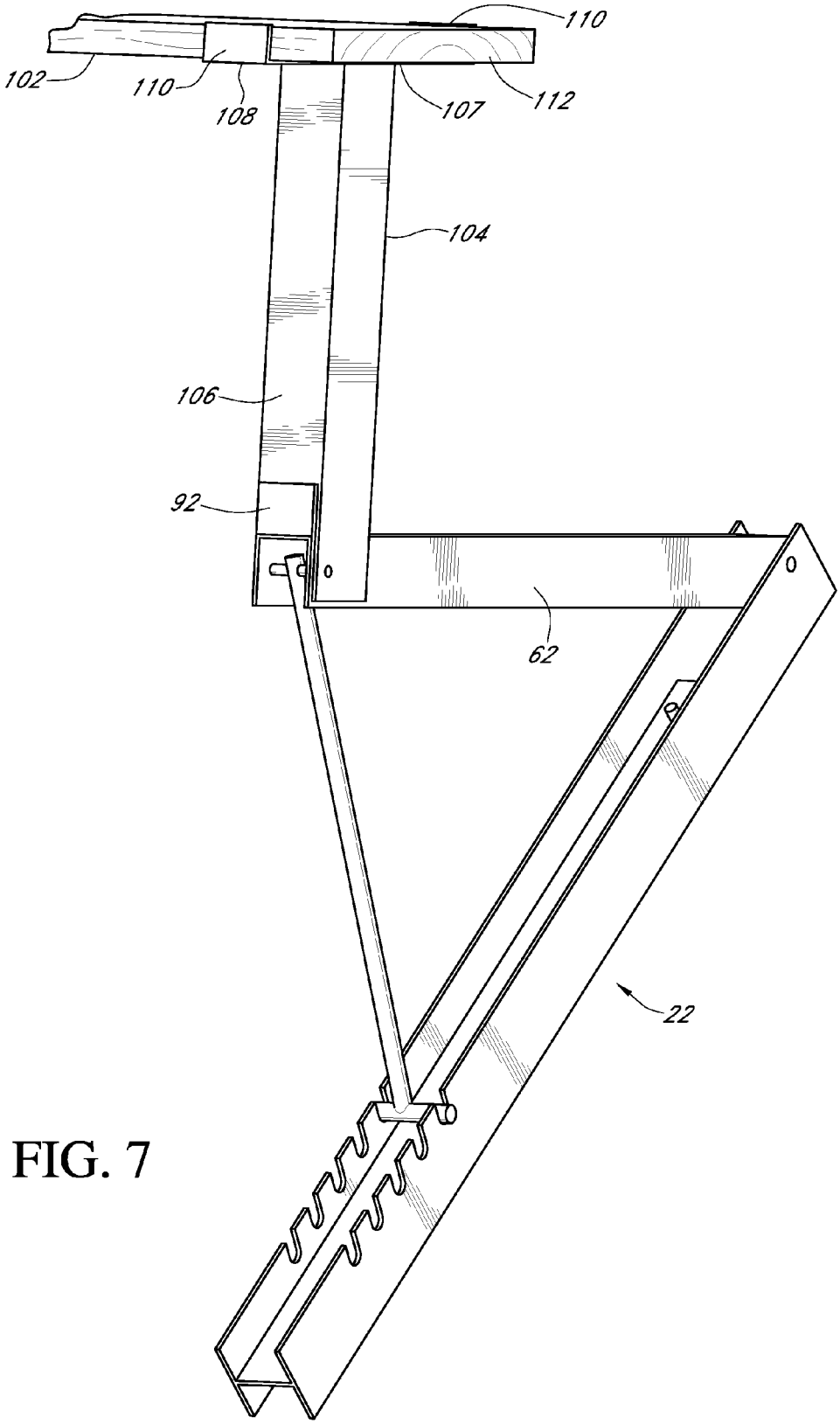
FIG. 7 is a perspective of the plank support bracket equipped with an optional worktable support stand supported thereon.

Referring now particularly to FIG. 7, an optional work table 102 supported by support stand 104 is shown mounted upon plank support bracket 22. Specifically, support stand 104 upstands upon plank support arm 62 at distal end 82 thereof such that leg 106 of support stand 104 abuts stop plate 92. Mounted to upper end 107 of leg 106 is shelf 108 which includes upstanding flanges 110 at opposing ends thereof. Work table 102 rests at one end thereof on shelf 108 and is supported by another support stand 104 mounted to the next adjacent plank support bracket 12 on an adjacent rail 12. Work table 102 may be a wooden board or some other elongate platform element capable of being supported near its end 112 by shelf 108.

It can be seen in FIG. 7 that work table 102 is spaced further away from the roof than a plank supported on plank support arm 62.

Figure 8:
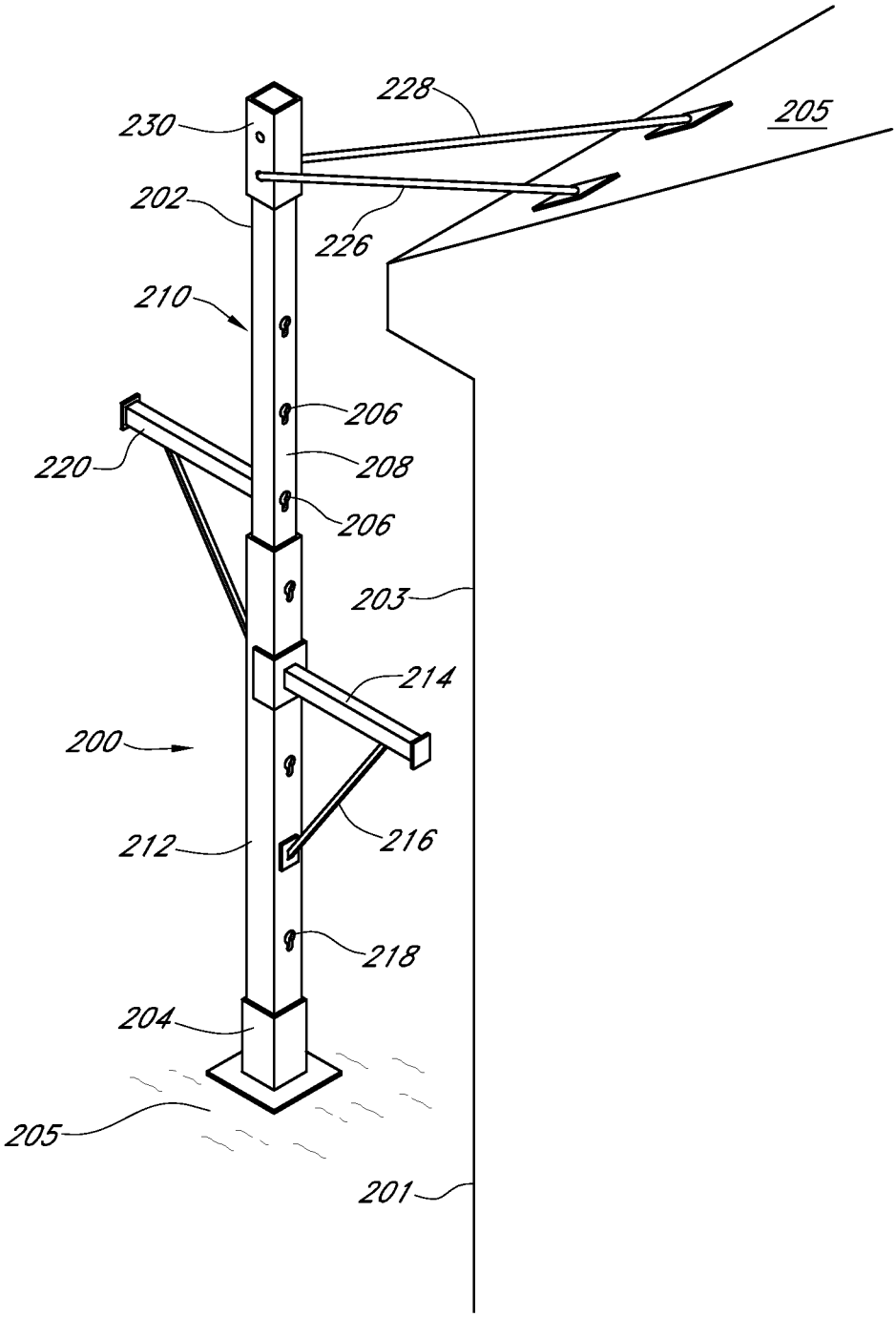
FIG. 8 is a perspective of an alternative scaffold support structure supported on a ground surface.

FIG. 8 illustrates a vertical scaffold member 200 which may be part of an upright scaffold system for use while working on a sidewall 203 of a building 201.

Vertical scaffold member 200 comprises an upright elongate post 202 which is supported on the ground surface 205 below. Post 202 is inserted into base 204 which rests on ground surface 205. Post 202 includes multiple slotted openings 206 on its house facing side 208 and on the opposing side 210.

Outer section 212 comprises a box tube which can receive telescoping segment 211, which may be raised and lowered and secured to outer section 212 by pins or bolts in a selected position. Support arm 214 is secured to post 202 by large headed bolts which extend into slotted openings 206 and lock into the narrows thereof. Support arm 214 is braced by brace member 216 which locks into a slotted opening 218 in outer section 212 of post 202.

A work table support bracket 220 extends from second side 210 of post 202 and includes lock bolts which are received in slotted openings 206 in second side of post 202.

Connecting arms 226, 228 are retained to top cap 230 atop post 202. Connecting arms 226, 288 are selectively retained to roof deck 205 by fasteners such as nails or screws while work is being carried out.

Figure 9:
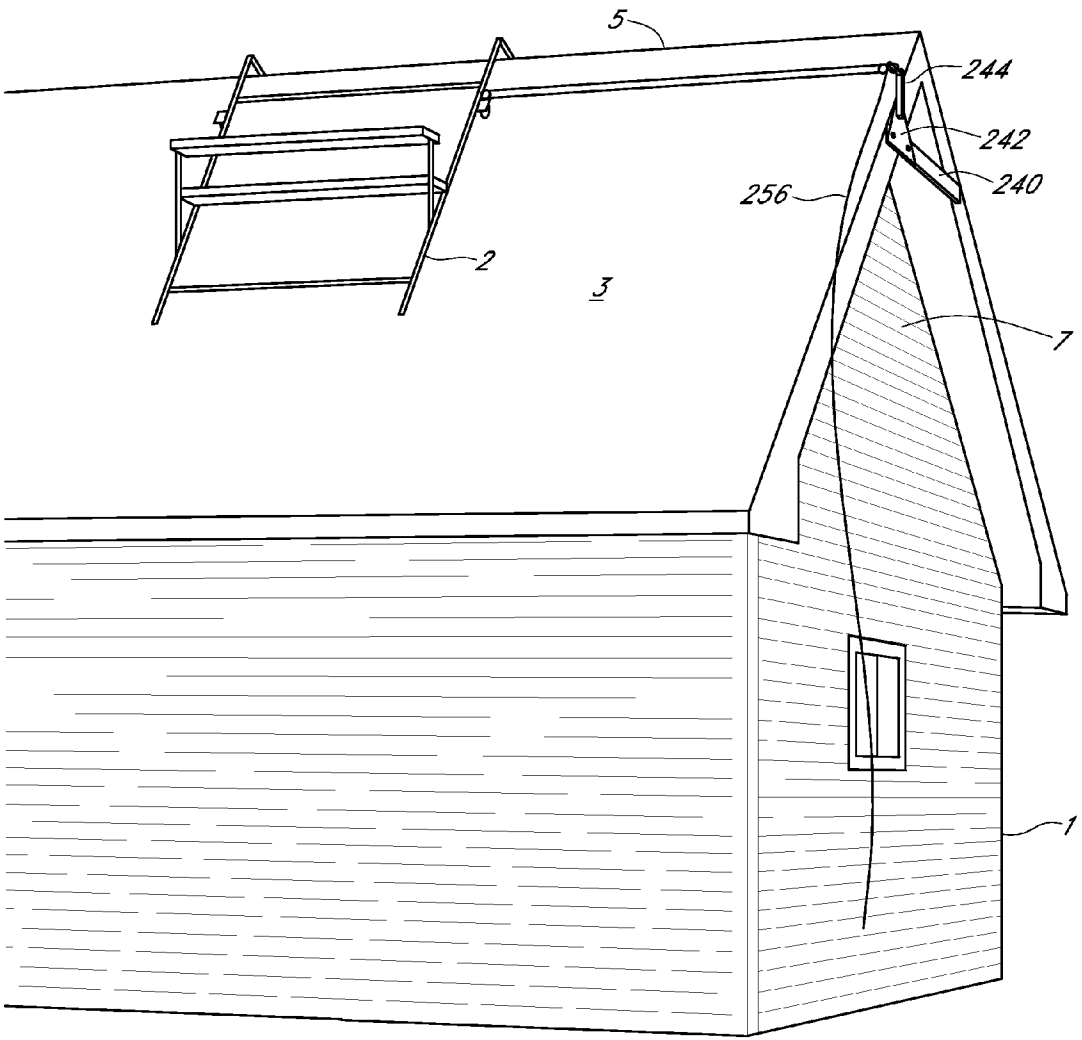
FIG. 9 is a perspective of the building having a roof on which a first alternative embodiment of the scaffold invention is in place.
Figure 10:
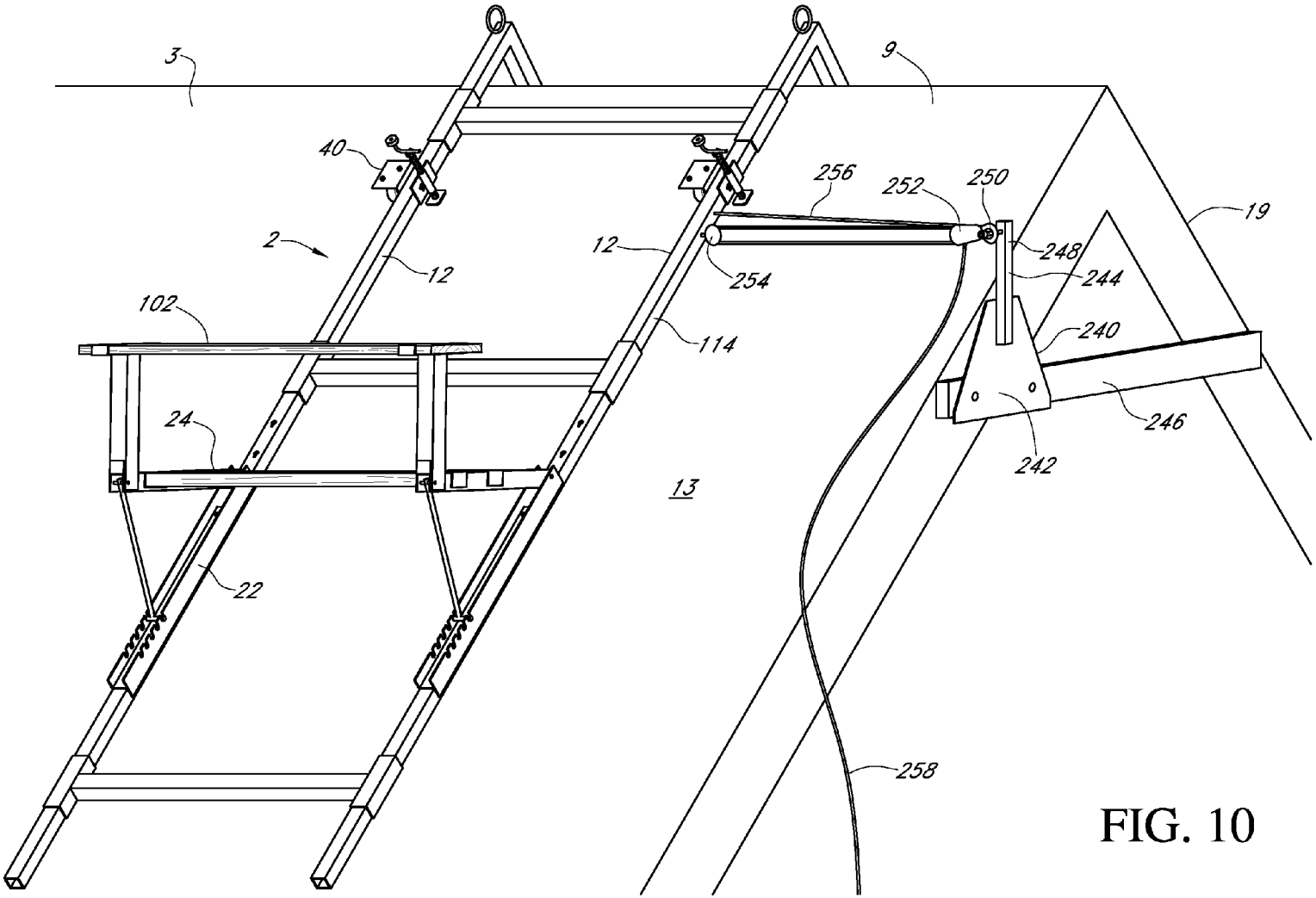
FIG. 10 is an enlarged perspective of the embodiment of FIG. 9.

FIGS. 9-12 illustrate alternative embodiments of the scaffold invention 2. In FIGS. 9-10, invention 2 is resting on the roof 3 to be repaired. Invention 2 has been readied for movement by raising of stand feet 140 from first roof surface 13 so that rails 12 rest on casters 42. Ridge hooks 10 of rails 12 rest against second side 19 of roof 3 so that invention 2 is ready to roll across roof 3 while ridge hooks 10 continue to prevent rails 12 from sliding down first side 9 of roof 3. By use of rope 256, a worker can move scaffold invention 2 to a location where work remains to be done, while doing so from a safe location. An anchor member 240 is shown attached to a cross beam 246 which has been temporarily attached to gable end 7 of building 1 near ridge 5. Anchor member 240 includes a plate 242 of generally triangular shape and a post 244 which extends from plate 242 such that its upper end 248 is positioned above the upper surface 13 of first side 9 of roof 3.

A pin 250 or other connection point is provided along upper end 248 and a double pulley 252 is attached to pin 250.

A single pulley 254 is attached to lateral side 114 of the rail 12 nearest anchor member 240. A rope 256 is routed from lateral side 114 of rail 12 to which it is attached to double pulley 252, back through single pulley 252 and then back through double pulley 252 with its free end 258 available to be grasped by a worker standing on the ground who may pull the rope to draw invention 2 across roof 3 toward gable end 7.

Figure 11:
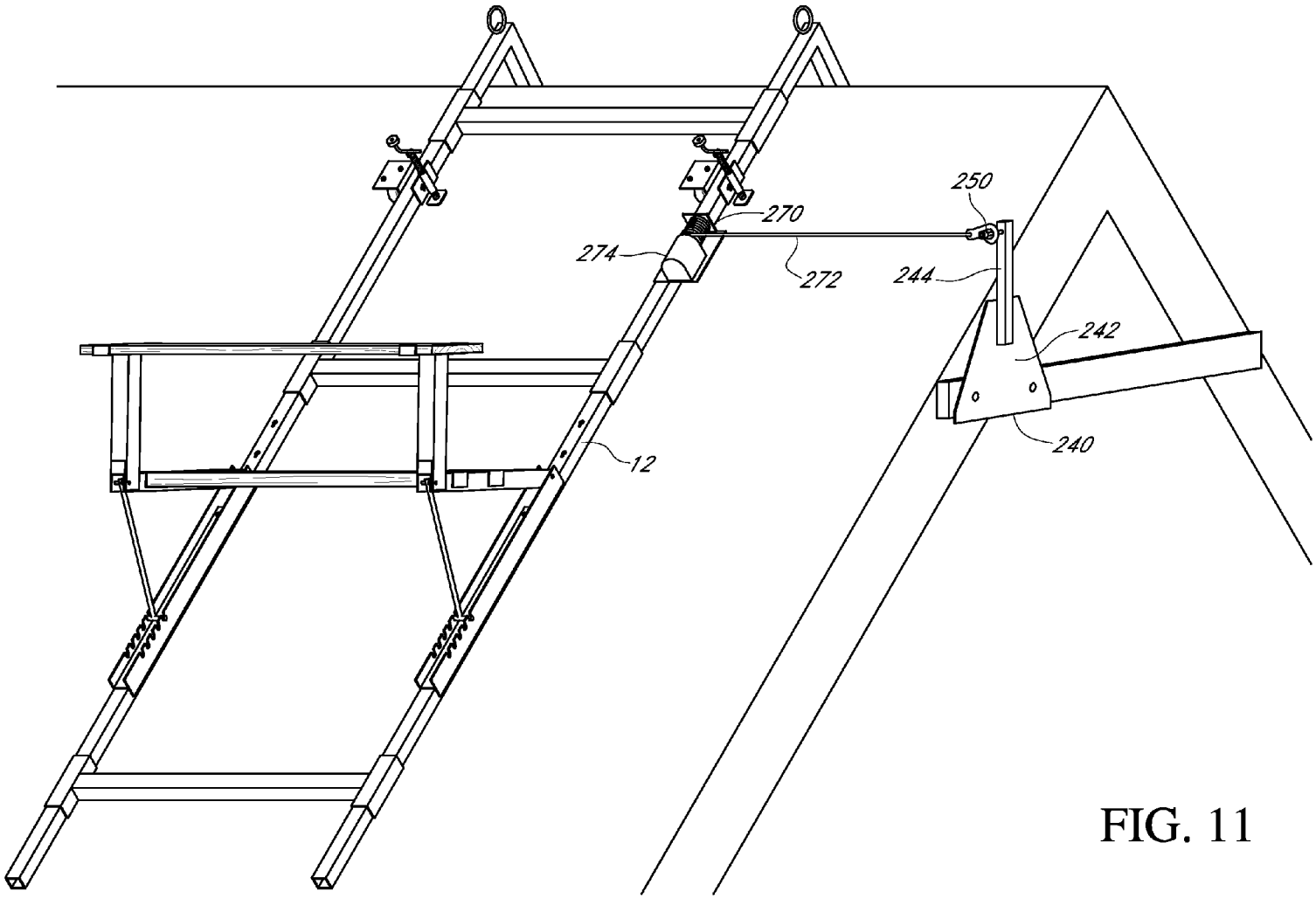
FIG. 11 is an enlarged perspective of a second alternative embodiment scaffold system.
Figure 12:
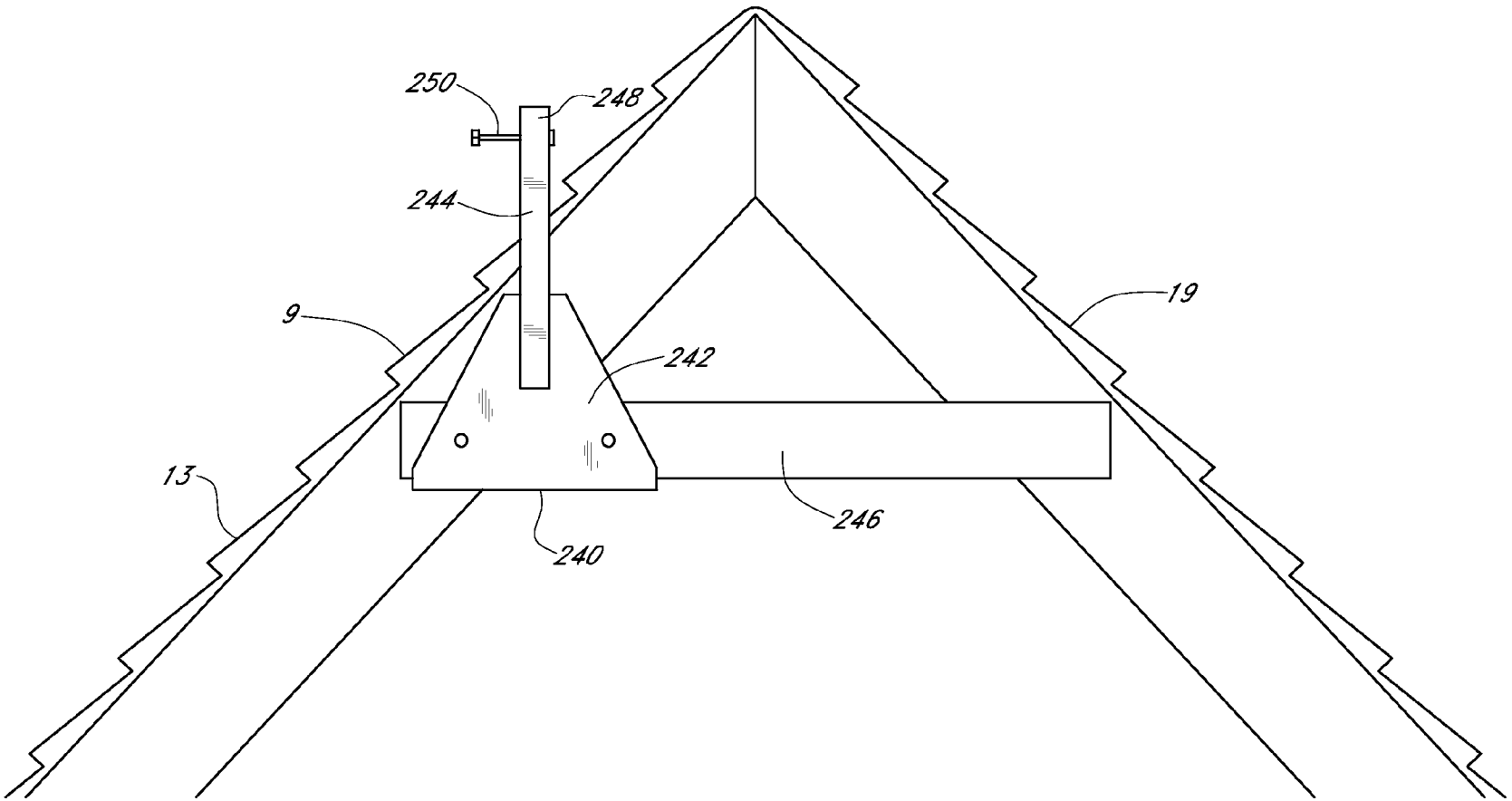
FIG. 12 is an enlarged elevation of the anchor member of the scaffold systems of FIGS. 9-11 attached to the gable end of a roof.

In another embodiment as seen in FIG. 11, a cable winch 270 may be attached to one of the rails 12 by winch bracket 274, with the free end of the cable 272 of the winch 270 connected to the anchor post 244. By powering the cable winch 270 by electricity, a worker may operate the winch 270, including remotely through a control pendant (not shown) to draw the scaffold system 2 nearer to the anchor member 240.

By use of clevis pins and openings, along with inverted large headed bolts to be selectively inserted in slotted openings, the invention permits easy alignment of plank locations as well as disassembly of the invention.

OPERATION OF THE PREFERRED EMBODIMENT

When roof repair or shingling is to be done on a steeply pitched roof, the worker may assemble the scaffold components including a rail 12 connected to ridge hook 10 and carry the assembly onto the roof by use of a ladder. The ridge hook 10 is placed over the ridge such that the caster 32 on the ridge hook 10 is in contact with the roof surface on the far side of the roof.

A second assembly of rail 12 and ridge hook 10 can be placed on the roof beside the first rail assembly. The rail assemblies may be maneuvered into appropriate spacing by rolling each rail assembly on casters 32 and 42. Cross members 16, 18, 20 may then be installed by removably connecting them to the spaced apart rails 12.

A plank support bracket 22 is installed on each rail 12 at an appropriate location along the rail 12. Then a plank 24 may be added by placing the plank 24 on the plank bracket support arms 62 while allowing the end brackets 98 of the plank 24 to capture the plank support arm 62 at each end of the plank 24. The scaffold assembly 2 is then rolled to a desired location for work to be done and the jack stands 44 are lowered so that the rails 12 are lifted off the casters 42 and the assembly is then stationary on the roof.

The angle of the plank 24 from roof side edge to opposite edge can be adjusted by moving the braces 60 of each plank support bracket 22 into a selected pair of slots 66.

When work in one area of the roof is complete, the jack stands 44 can be raised so that the rails 12 are supported on casters 42, 32 and the invention 2 may be moved sideways along the roof surface to another desired location.

When the optional alternative embodiments are used, an anchor member 240 is temporarily mounted to the gable end 7 of the roof 3 such that an anchor post 244 extends above the surface of the roof on which work is being performed. A first double wheel pulley 252 may be attached to the anchor post 244 and another pulley 254 which need only be a single wheel pulley may be attached to the rail 12 closest to the anchor member 240. A rope 256 or other cable may be looped around the pulleys 252 and 254 such that a worker may draw on the rope 256 to cause the scaffold system 2 to move toward the anchor member 240.

When the second alternate embodiment system employing a cable winch 270 is used, the cable winch 270 is attached to rail 12 closest to the anchor 240, with the free end of the cable 272 of the winch 270 connected to the anchor post 244. By powering the cable winch 270 by electricity, a worker may operate the winch 270, including remotely through a control pendant (not shown) to draw the scaffold system 2 nearer to the anchor member 240. These alternative embodiments enhance the safety of operation of the scaffold system 2 by allowing the worker to move the scaffold system 2 along the roof while safely standing on the ground.

These alternative embodiments enhance the safety of operation of the scaffold system 2 by allowing the worker to move the scaffold system 2 along the roof while safely standing on the ground.

The foregoing description of the invention has been presented for purposes of illustration and description and is not intended to be exhaustive or to limit the invention to the precise form disclosed. Modifications and variations of the embodiments are possible in light of the above disclosure or such may be acquired through practice of the invention. The embodiments illustrated were chosen in order to explain the principles of the invention and its practical application to enable one skilled in the art to utilize the invention in various embodiments and with various modifications as are suited to the particular use contemplated. It is intended that the scope of the invention be defined by the claims appended hereto, and by their equivalents.

Having described the invention, I claim:

1. A scaffolding system for use on a pitched roof, the roof having a first side and a second side, the first side and the second side separated by a ridge, the invention comprising at least two elongate spaced apart rail members, each rail member having a longitudinal axis, the at least two rail members generally parallel with each other, each rail member extending along a slope of the first side of the roof, each rail member including a ridge hook at an upper end thereof, each ridge hook extending over the ridge of the roof and overlying a portion of the second side of the roof, each ridge hook including a roof facing side, a caster mounted to the roof facing side of each ridge hook, the caster of each ridge hook supported by the second side of the roof, each caster capable of rolling in a direction substantially perpendicular to the longitudinal axis of the rail member, a plank supporting bracket supported along each rail, a plank spanning the space between the rails and supported by the plank supporting brackets of adjoining rails, the at least two rail members are maintained in spaced apart parallel relationship by at least two cross members, each of the at least two cross members connected to each of the at least two rail members, the plank being retained to each of the plank supporting brackets by end brackets, the end brackets resisting longitudinal movement of the plank relative to the plank supporting brackets, each rail member includes at least one caster underlying and supporting the rail member, the at least one caster of the rail member is capable of rolling in a direction perpendicular to the longitudinal axis of the rail member, the at least one caster of each rail member supporting the rail member above the first side of the roof, each plank supporting bracket is selectively positionable along the rail member on which it is supported, each rail member includes a plurality of spaced apart slotted holes therealong, the slotted holes in a top of the rail member, each plank supporting bracket includes a base member, the base member overlies a section of the rail member, the base member including a pin depending from an underside thereof, the pin selectively receivable in a one of the slotted holes of the rail member, each plank supporting bracket further includes:

a plank support arm hinged to the base member of the plank supporting bracket, the plank support arm adjustably supported by a brace hinged to a free end of the plank support arm, the brace having a free end, the free end of the brace having a transverse bar, the base member including plural receiving elements to receive a free end of the brace, the angle between the plank support arm and the rail member variable based on selection of a one of the plural receiving elements by placing of the transverse bar of the free end of the brace in a selected one of the receiving elements of the base member.

2. The scaffolding system of claim 1 wherein the base member includes a pair of spaced apart substantially vertical sidewalls joined by a transverse wall, the substantially vertical sidewalls of the base member disposed alongside opposing longitudinal sides of the rail member when the base member is mounted to the rail member.

3. The scaffolding system of claim 2 wherein the plural receiving elements are a plurality of paired slots formed in top edges of the substantially vertical sidewalls of the base member, the transverse bar receivable in a selected one of the plurality of paired slots.

4. The scaffolding system of claim 1 wherein each plank supporting bracket is selectively positionable along the rail member on which it is supported, each rail member includes a plurality of spaced apart slotted holes therealong, the slotted holes in a top of the rail member, each plank supporting bracket includes a base member, the base member overlies a section of the rail member, the base member including a pin depending from an underside thereof, the pin selectively receivable in a one of the slotted holes of the rail member.

5. A scaffolding system for use on a pitched roof, the roof having a first side and a second side, the first side and the second side separated by a ridge, the invention comprising at least two elongate spaced apart rail members, each rail member having a longitudinal axis, the at least two rail members generally parallel with each other, each rail member extending along a slope of the first side of the roof, each rail member including a ridge hook at an upper end thereof, each ridge hook extending over the ridge of the roof and overlying a portion of the second side of the roof, each ridge hook including a roof facing side, a caster mounted to the roof facing side of each ridge hook, the caster of each ridge hook supported by the second side of the roof, each caster capable of rolling in a direction substantially perpendicular to the longitudinal axis of the rail member, a plank supporting bracket supported along each rail, a plank spanning the space between the rails and supported by the plank supporting brackets of adjoining rails, an anchor member adapted for mounting to a gable end of a building on which the roof is supported, means on one of the rail members to draw the rail members toward the anchor member.

6. The scaffolding system of claim 5 the anchor member includes an attachment point, the means on one of the rail members to draw the rail members toward the anchor member comprises a winch mounted along a one of the rails, motive power coupled to the winch to cause it to wind a cable thereon, the cable joining the winch to the attachment point on the anchor member.

7. The scaffolding system of claim 5 wherein the anchor member includes an upright member extending to a height above the first side of the roof, the anchor member including an attachment point, the attachment point being on the upright member.

8. The scaffolding system of claim 5 wherein the means on one of the rail members to draw the rail members toward the anchor member includes a first pulley attached to a first of the at least two rail members, the anchor member including a connection point for attachment of a rope thereto, a second pulley attached to the connection point, and a rope passing about the first and second pulleys, the rope having a first end fastened to the first of the at least two rail members, the rope having an opposing second end free for use of a user to draw the scaffolding system toward the anchor member.

9. The scaffolding system of claim 5 wherein each rail member includes a stand assembly, the stand assembly includes the at least one caster and a stand foot mounted on a jack stand, the jack stand selectively adjustable to cause the stand foot to press against the first side of the roof to selectively elevate the at least one caster of the rail member.

10. The scaffolding system of claim 5 wherein each plank supporting bracket is selectively positionable along the rail member on which it is supported, each rail member includes a plurality of spaced apart slotted holes therealong, the slotted holes in a top of the rail member.

11. A scaffolding system for use on a pitched roof, the roof having a first side and a second side, the first side and the second side separated by a ridge, the invention comprising at least two elongate spaced apart rail members, each rail member having a longitudinal axis, the at least two rail members generally parallel with each other, at least two cross members linking the at least two rail members, the at least two cross members being spaced apart, each cross member substantially parallel to the other cross member, each of the at least two cross members removably attached to the at least two rail members, each of the at least two cross members spaced apart from opposing ends of the at least two rail members, each rail member extending along a slope of the first side of the roof, each rail member including a ridge hook at an upper end thereof, each ridge hook extending over the ridge of the roof and overlying a portion of the second side of the roof, each ridge hook including a roof facing side, a caster mounted to the roof facing side of each ridge hook, the caster of each ridge hook supported by the second side of the roof, each caster capable of rolling in a direction substantially perpendicular to the longitudinal axis of the rail member a plank supporting bracket supported along each rail, a plank spanning the space between the rails and supported by the plank supporting brackets of adjoining rails, the plank being retained to each plank supporting bracket so that the plank may not move longitudinally relative to the plank supporting brackets, each of the at least two rail members being selectively immovable laterally along the first side of the pitched roof, each rail member includes at least one stand assembly, the stand assembly including at least one caster and a stand foot mounted on a jack stand, the caster underlying and selectively supporting the rail member, the at least one caster of each rail member supporting the rail member above the first side of the pitched roof, the jack stand selectively adjustable to cause the stand foot to press against the first side of the roof to elevate the at least one caster of the rail member, the at least one caster of the rail member is capable of rolling in a direction perpendicular to the longitudinal axis of the rail member, the stand assembly further comprising a bracket member, the at least one caster of the rail member is mounted to the bracket member, the bracket member detachably mounted to the rail member, the bracket member including a plate from which the at least one caster depends, the bracket member further including an open topped channel into which the rail member is removably received, the plate disposed alongside the rail member to which the bracket member is detachably mounted.

12. The scaffolding system of claim 11 wherein the open topped channel is selectively mounted to the rail member by at least one removable cross pin, the stand foot comprising a foot plate at a lower end of the threaded rod, the jack stand including a sleeve through which the threaded rod is received, the sleeve mounted to a substantially vertical sidewall of the open topped channel.

13. A scaffolding system for use on a pitched roof, the roof having a first side and a second side, the first side and the second side separated by a ridge, the invention comprising at least two elongate spaced apart rail members, each rail member having a longitudinal axis, the at least two rail members generally parallel with each other, at least two cross members linking the at least two rail members, the at least two cross members being spaced apart, each cross member substantially parallel to the other cross member, each of the at least two cross members removably attached to the at least two rail members, each of the at least two cross members spaced apart from opposing ends of the at least two rail members, each rail member extending along a slope of the first side of the roof, each rail member including a ridge hook at an upper end thereof, each ridge hook extending over the ridge of the roof and overlying a portion of the second side of the roof, each ridge hook including a roof facing side, a caster mounted to the roof facing side of each ridge hook, the caster of each ridge hook supported by the second side of the roof, each caster capable of rolling in a direction substantially perpendicular to the longitudinal axis of the rail member a plank supporting bracket supported along each rail, a plank spanning the space between the rails and supported by the plank supporting brackets of adjoining rails, the plank being retained to each plank supporting bracket so that the plank may not move longitudinally relative to the plank supporting brackets, each of the at least two rail members being selectively immovable laterally along the first side of the pitched roof, each plank supporting bracket is selectively positionable along the rail member on which it is supported, each rail member includes a plurality of spaced apart slotted holes therealong, the slotted holes in a top of the rail member, each plank supporting bracket includes a base member, the base member overlies a section of the rail member, the base member comprising an upper channel and a lower channel, the lower channel including sidewalls depending from a transverse wall thereof, the sidewalls disposed alongside opposing sides of the rail member, the base member including a pin depending from an underside thereof, the pin selectively receivable in a one of the slotted holes of the rail member, each plank supporting bracket further includes:

a plank support arm hinged to the base member of the plank supporting bracket, the plank support arm adjustably supported by a brace hinged to a free end of the plank support arm, the brace having a free end, the base member including plural receiving elements to receive a free end of the brace, the angle between the plank support arm and the rail member variable based on selection of a one of the plural receiving elements by placing of the free end of the brace in a selected one of the receiving elements of the base member, the free end of the brace having a transverse bar, each of the plural receiving elements being a pair of open topped slots along the base member, the transverse bar receivable in a one of the pairs of the plural open-topped slots of the base member, each of the rail members including an upper rail and a lower rail, the upper rail having a joiner secured thereto, the joiner accepting an upper end of the lower rail, a pin selectively attaching the upper end of the lower rail to the joiner by passing through a hole on the joiner aligned with a hole on the upper end of the lower rail.

* * * * *